United States Patent [19]

Romey et al.

[11] 4,104,150

[45] Aug. 1, 1978

[54] PROCESS FOR THE PRODUCTION OF COKE FROM PITCH

[75] Inventors: Ingo Romey, Drevenack; Georg Kölling; Hellmut Kokot, both of Essen, all of Fed. Rep. of Germany

[73] Assignee: Bergwerksverband GmbH, Essen, Fed. Rep. of Germany

[21] Appl. No.: 765,892

[22] Filed: Feb. 7, 1977

Related U.S. Application Data

[63] Continuation-in-part of Ser. No. 596,055, Jul. 7, 1975, abandoned.

[30] Foreign Application Priority Data

Jul. 17, 1974 [DE] Fed. Rep. of Germany ..... 2434295

[51] Int. Cl.[2] ..... C10G 9/14

[52] U.S. Cl. ..... 208/91; 208/131

[58] Field of Search ..... 208/91, 106, 131

[56] References Cited

U.S. PATENT DOCUMENTS

| | | | |
|---|---|---|---|
| 2,166,321 | 7/1939 | Pott | 264/105 |
| 2,775,549 | 12/1956 | Shea | 208/131 |
| 3,704,224 | 11/1972 | Scovill et al. | 208/131 |
| 3,799,865 | 3/1974 | Suetsugu et al. | 208/131 |

FOREIGN PATENT DOCUMENTS

| | | | |
|---|---|---|---|
| 1,189,517 | 12/1965 | Fed. Rep. of Germany | 208/131 |
| 847,840 | 9/1960 | United Kingdom | 208/131 |

*Primary Examiner*—Herbert Levine

*Attorney, Agent, or Firm*—Michael J. Striker

[57] ABSTRACT

Coal-tar pitch is heated to a temperature which is at least 100° C above its softening point but below its decomposition temperature and is mixed with a filter aid, such as kieselghur or activated carbon prior to filtering the pitch at at least the preheat temperature so as to remove ashes, soot and heavy metals therefrom. The thus-purified pitch is then coked. In this manner, it is possible to obtain high-quality, anisotropic acicular coke which is readily convertible into graphite.

10 Claims, 5 Drawing Figures

PROCESS FOR THE PRODUCTION OF COKE FROM PITCH

RELATED APPLICATIONS

This application is a continuation in part of application Ser. No. 596,055 filed July 7, 1975 now abandoned.

BACKGROUND OF THE INVENTION

The invention relates generally to a process for the production of coke. Of particular interest to the invention is the production of premium coke, which is also referred to as acicular coke.

Premium or acicular coke is, in particular, characterized by a good convertibility to graphite. Important characteristics of such coke are as follows (compare the publication by Winnacker, Kuchler entitled "Chemische Technologie" and published by Carl Hanser of Munich, Germany in 1970; vol. 1 (Anorganische Technologie), page 474):

| | |
|---|---|
| Density after annealing at 1300° C: | 2.0 - 2.17 grams per cubic centimeter |
| Coefficient of thermal expansion after annealing at 2700° C: | $4.5.10^{-6}$ — $5.5.10^{-6}$ per ° C |
| Convertibility to graphite: | 1.45 - 1.65 |

A process for the production of anisotropic coke which is readily converted into graphite is already known. Here, bituminous coal-tar pitch is mixed with an aromatic diluent which is derived from petroleum or bituminous coal-tar. The portions of the pitch which remain in the form of solid particles are removed from the resulting mixture by decanting, filtering or other separating procedures at a temperature of approximately 150° C. The thus-clarified mixture is then coked and calcined at temperatures of 1450° to 1500° C using the delayed-coking process. The delayed-coking process resides in that, starting at about 350° C, the pitch is coked within a period of approximately 24 hours while increasing the temperature to about 1550° C.

This method for the preparation of coke possesses certain disadvantages. Thus, extensive and time-consuming operations are required for the production of the starting product from which the coke is derived. For instance, the diluent must be driven off and there are great technical problems associated with the distillation stage. Moreover, a complete removal of the diluent is not possible in practice. As a result, residual diluent is driven off in the apparatus used for the delayed-coking procedure and this causes disturbances in the coking apparatus.

SUMMARY OF THE INVENTION

Accordingly, the object of the invention is to provide an important process for the production of acicular coke from coal-tar pitch.

These, as well as other objects which will become apparent hereinafter, are achieved by mixing the pitch with a filtering aid and filtering the pitch at a temperature above the softening point thereof so as to remove ashes, soot and heavy metals from the pitch; and finally coking the filtered pitch.

DESCRIPTION OF THE PREFERRED EMBODIMENTS

Figure 1:
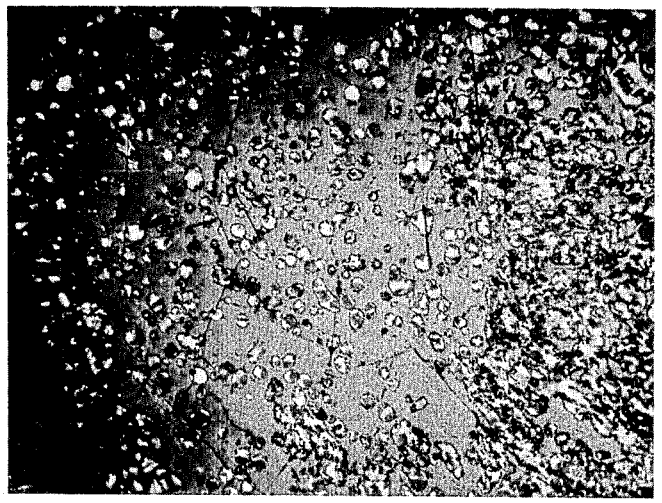
FIG. 1 is a photomicrograph, at a magnification of 430 times, of non-purified pitch.

As has been indicated previously, of particular interest to the invention is the production of premium or acicular coke.

It has now been found that it is possible, with relatively little in the way of technical problems, to obtain good premium coke by the coking of coal-tar pitch. This may be achieved in that the coal-tar pitch is freed of ashes, soot and heavy metals by means of filtration and is subsequently coked. The coke obtained by coking of the thus-prepared pitch may have a convertibility to graphite which is between about 1.40 and 1.60 and may thus fulfill all of the requirements associated with a qualitative, high-quality premium coke.

The coal-tar pitch which is used in accordance with the invention is preferably bituminous coal-tar pitch, that is, coal-tar pitch which is derived from bituminous coal. Advantageously, the coal-tar pitch has a Kramer-Sarnow softening point between about 35° and 180° C.

The filtration is carried out at temperatures above the softening point of the pitch. It is particularly favorable for the filtration to be carried out at temperatures which are at least 100° C above the softening point. However, the filtration should be carried out at temperatures below the decomposition temperature of the pitch.

The coking of the filtered or purified pitch may be carried out using the delayed-coking procedure. A manner of carrying out the delayed-coking procedure is, for instance, described in the publication "Hydrocarbon Processing", vol. 47, No. 9, page 151 (September 1968).

The pitch of the process according to the invention has a high binding power for carbon-containing materials. Accordingly, the pitch is well-suited as a binding agent for other carbon-containing materials which are capable of being coked and it is possible to mix the pitch with such other carbon-containing materials prior to coking. It is particularly advantageous for the pitch to be used as a binding agent for other, known carbon-containing materials which are likewise capable of yielding premium coke upon coking.

Mixtures of pitch prepared according to the invention with carbon-containing materials which, of themselves, are also capable of yielding premium coke, may be desirable in cases where the carbon-containing materials do not possess a desired cohesiveness. For instance, if electrodes are to be produced from a carbon-containing material which, of itself, is capable of yielding premium coke, but which, however, does not possess the desired cohesiveness, then it is possible to mix this carbon-containing material with pitch prepared according to the invention prior to coking. Mixtures of the type under consideration may, for example, contain 15 to 30% by weight of filtered pitch and 70 to 85% by weight of other, carbon-containing materials. It will, however, be understood that, in practice, pitch filtered in accordance with the invention, on the one hand, and other carbon-containing materials, on the other hand, may also be mixed in all other proportions. Examples of carbon-containing materials other than pitch which, of themselves, are capable of yielding premium coke, are petroleum coke and pitch coke.

The invention is based on the recognition that the impurities such as ashes, soot, iron and zinc present in unfiltered pitch lead to discontinuities or faults in the crystal growth. As a result, zones of low electrical conductivity, as well as zones of differing coefficient of thermal expansion, are formed during the coking of non-purified pitch. These zones cause stresses to be set up and thus readily lead to the formation of cracks. This may be avoided in accordance with the invention. Moreover, due to the impurities which are present in untreated pitch, and which do not contribute to the formation of coke, the yield of coke which has been purified according to the invention is greater than that from untreated pitch.

Practically all pitches having a softening point in the range indicated above, that is, a Kramer-Sarnow softening point between about 35° and 180° C, are suitable as starting materials for the process according to the invention. However, pitch having a Kramer-Sarnow softening point between about 60° and 150° C is particularly well-suited.

It is favorable to assist the filtration of the pitch by adding at least 5 g per kg of crude pitch of filter aids such as kieselghur, activated carbon or the like to the pitch. The filtering aid in these cases acts as an adsorbent for the undesirable components of the crude pitch which would interfere with the crystal growth.

All filters having filter elements of metal, paper or synthetic resin may be used for filtering the pitch. Advantageously, the mesh size of the filter element is between about 3 and 200 microns.

Pressure filters, that is, filters which operate at a pressure in excess of atmospheric pressure, have been found to be particularly favorable for carrying out a process according to the invention. In particular, filters which operate at pressures between about 2 and 10 bars have been found to be very well-suited.

By means of the filtration according to the invention, only such components as retard the crystal growth during the subsequent coking are removed from the pitch, that is, as already mentioned, the filtration according to the invention removes ashes, soot and heavy metals from the pitch. This is in contrast to those methods for the preparation of pitch which are carried out with the aid of a diluent or solvent such as, for instance, the method according to the German Auslegeschrift No. 2,064,695 outlined earlier. Above all, by using the filtration according to the invention, there remain in the pitch macromolecules of components having a high carbon content, that is, macromolecules of components which are not wasted during the coking and which lead to particularly large yields of coke as compared to the yield for the coking of petroleum coke.

The surprising effect of a simple, hot filtration on the capability of pitch to be converted to graphite is illustrated in the Figures.

FIG. 1 is a photograph of a non-purified pitch. The impurities in the pitch are seen as a dark border about the pitch crystals. These impurities are responsible for the disturbed crystal growth.

Figure 2:
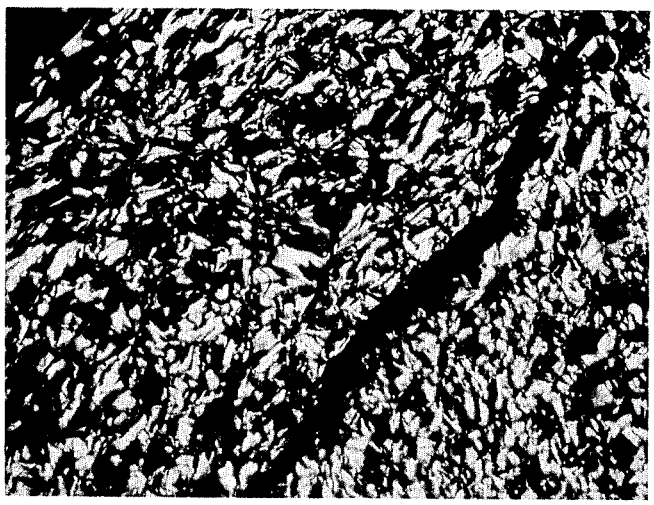
FIG. 2 is a photomicrograph, at a magnification of 430 times, of coke derived from non-purified bituminous coal-tar pitch.

FIG. 2 is a photograph of coke obtained from non-purified bituminous coal-tar pitch. Due to the separation layer formed by the impurities in the pitch, the pitch crystals are unable to grow into one another. As a result, only very small crystals are formed.

Figure 3:
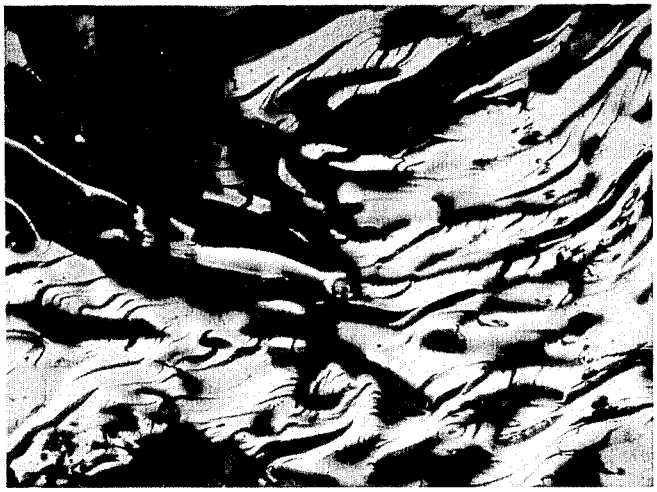
FIGS. 3-5 are photomicrographs, at a magnification of 430 times, of pitch which has been purified in accordance with the invention.
Figure 4:
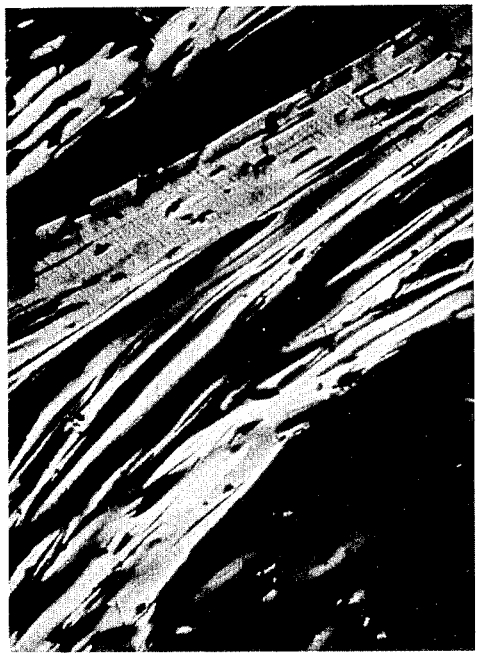
Figure 5:
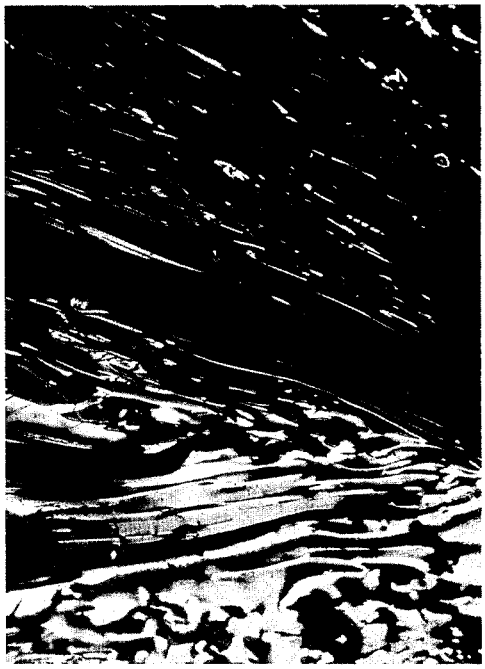

FIGS. 3–5 are photographs of various pitches which have been purified in accordance with the invention. These photographs show the large area over which the regions of anisotropy extend. The large anisotropic regions are a measure of the advantageous capability of the pitch to be converted to graphite.

The following examples are presented to further illustrate the invention and are not intended to limit the same in any manner:

EXAMPLE 1

Ten kilograms of a crude, briquetted pitch having a Kramer-Sarnow softening point of 75° C is heated to 200° C. The pitch is mixed with 500 grams of kieselghur and is then filtered in a pressure filter having a metallic filter element. The filtration is carried out at a temperature of 270° C through a filter having a mesh size of 150 microns at a pressure of 5 bars. There is thus obtained 6.5 kilograms of pitch filtrate. The composition of the filtered pitch, as well as the composition of unfiltered pitch, both in weight percent, are set forth in the following table:

| | Crude (unfiltered) pitch | Filtered pitch |
|---|---|---|
| C | 92.30 | 92.60 |
| H | 4.45 | 5.04 |
| S | 1.07 | 0.21 |
| N | 1.18 | 1.21 |
| O | 0.80 | 0.90 |
| Cl | 0.04 | 0.04 |
| Zn | 0.01 | — |
| Ashes | 0.15 | — |
| Coke Yield | 73.4% | 75.6% |

Three kilograms of the still fluid, hot pitch filtrate having a temperature of approximately 150° C are carbonized in a delayed-coker at a temperature of about 480° C and a pressure of 3 atmospheres in excess of atmospheric pressure. There is thus obtained 2.6 kilograms of low-temperature coke which is further coked in a tubular oven at a temperature of 1000° C. The coke has a sulfur content of 0.2% and exhibits a convertibility to graphite of 1.5. The metallic content of the coke is not measurable. The coefficient of thermal expansion is $3.5 \cdot 10^{-6}$ per ° C at an annealing temperature of 1300° C and $2.4 \cdot 10^{-6}$ per ° C at an annealing temperature of 2700° C.

EXAMPLE 2

The same procedure is followed as in Example 1 with the following exceptions: (a) the pitch used here is a hard pitch having a Kramer-Sarnow softening point of 150° C; (b) shaped bodies of activated carbon are here added as a filter aid; and (c) the hot pitch is here filtered at a temperature of 300° C. The quantity of pitch filtrate obtained is 8.5 kilograms. By further processing this pitch filtrate both alone and in admixture with finely divided petroleum coke, there is obtained coke having practically the same characteristics as in Example 1.

It will be understood that each of the elements described above, or two or more together, may also find a useful application in other types of processes differing from the types described above.

While the invention has been illustrated and described as embodied in a process for the production of acicular coke from coal-tar pitch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. The improvement in preparing pitch for a coking procedure to obtain acicular coke of premium quality wherein the pitch is subjected to a preliminary filtration to remove undesirable elements, including ashes, soot and heavy metals therefrom, the said improvement comprising preheating crude coal tar pitch to at least 100° C above its softening point and a point below its decomposition temperature, mixing the pitch with at least 5 g of a particulate solid adsorbent filtering aid per kg of crude pitch prior to filtration and then filtering the coke at at least the said preheat temperature in the absence of a solvent or diluent through a pressure filter having a mesh size of about 3–200 $\mu$ at a pressure of about 2 to 10 bars, followed by subjecting the pitch to said coking procedure.

2. The process of claim 1 wherein the filtering aid is kieselghur or activated carbon.

3. The process of claim 1 wherein the filtrate is effected at a temperature higher than said preheating temperature.

4. The process of claim 1 wherein the pitch is a bituminous coal tar pitch which has a Kramer-Sarnow softening point between about 35° and 180° C.

5. The process of claim 4 wherein the pitch has a Kramer-Sarnow softening point between about 60° and 150° C.

6. The process of claim 1 wherein the crude pitch is preheated to about 200° C and is then filtered at about 270° to 300° C.

7. The process of claim 6 wherein the pressure is about 5 bar.

8. The process of claim 1 wherein other carbon-containing materials adapted for coking are added to the pitch prior to said coking procedure, the pitch then acting as a binder for the other carbon-containing materials.

9. The process of claim 8 wherein the other carbon-containing materials are petroleum coke or pitch coke.

10. The process of claim 1 wherein the coking is carried out in a delayed coking operation.

* * * * *